US006101829A

United States Patent [19]

Robinson

[11] Patent Number: 6,101,829

[45] Date of Patent: Aug. 15, 2000

[54] AIR CONDITIONING APPARATUS

[75] Inventor: Philip R. Robinson, Mulvane, Kans.

[73] Assignee: Airxcel, Inc., Wichita, Kans.

[21] Appl. No.: 09/399,482

[22] Filed: Sep. 20, 1999

[51] Int. Cl.[7] ..... F25D 23/12

[52] U.S. Cl. ..... 62/259.1; 62/298; 62/419

[58] Field of Search ..... 62/298, 259.1, 62/326, 411, 419, 426

[56] References Cited

U.S. PATENT DOCUMENTS

| | | | |
|---|---|---|---|
| 4,129,013 | 12/1978 | Hine, Jr. . | |
| 4,293,032 | 10/1981 | Asp . | |
| 4,373,576 | 2/1983 | Strupczewski . | |
| 4,698,982 | 10/1987 | Laios et al. . | |
| 4,805,418 | 2/1989 | Ishizuka et al. | 62/298 |
| 4,874,040 | 10/1989 | Herrmann | 62/259.1 X |
| 5,377,503 | 1/1995 | Reedy et al. . | |
| 5,444,990 | 8/1995 | McGill et al. | 62/298 |

OTHER PUBLICATIONS

Duo–Therm™ by Dometic, Installation & Operating Instructions, Self–Contained Air Conditioner For Recreational Vehicle/Park Model 39115 & 39045, Jun. 1995.

*Primary Examiner*—William Doerrler
*Assistant Examiner*—Chen-Wen Jiang
*Attorney, Agent, or Firm*—Shook, Hardy & Bacon L.L.P.

[57] ABSTRACT

The present invention relates to an air conditioner apparatus comprising a housing including top and side walls, and presenting an air inlet and first and second air outlets, the first and second air outlets being disposed on different ones of the top and side walls. A blower assembly including a central axis about which the blower assembly is supported for rotation relative to the housing, the blower being in fluid communication with the air inlet and the first and second air outlets for forcing air under pressure from the air inlet to the first and second air outlets. A first removable air outlet cover assembly for blocking the air under pressure from being discharged through the first air outlet, the first removable air outlet cover assembling including a first flow control structure for directing air under pressure toward the second air outlet. A second removable air outlet cover assembly for blocking the air under pressure from being discharged through the second air outlet, the second removable air outlet cover assembly including a second flow control structure for directing air under pressure toward the first air outlet. When the first removable air outlet cover assembly is removed, the second flow control structure of the second removable air outlet cover assembly directs air under pressure toward the first air outlet; and wherein, when the second removable air outlet cover assembly is removed, the first flow control structure of the first removable air outlet cover assembly directs air under pressure toward the second air outlet.

8 Claims, 2 Drawing Sheets

AIR CONDITIONING APPARATUS

BACKGROUND OF THE INVENTION

The present invention relates generally to an air conditioning unit, and, more particularly, to a self-contained air conditioning unit for use with RVs, mobile homes, park units, elevator cars, and the like. Specifically, the air conditioning unit of the present invention allows for convenient installation in a number of orientations.

It is conventional to provide self-contained air conditioning apparatus for park units, mobile homes, and the like. These apparatuses can be mounted in any number of orientations to allow for efficient cooling of the interior space of the units, and are typically manufactured with an air outlet on either the top or the side of the apparatus, depending upon the installation orientation desired.

There are certain drawbacks to the conventional single discharge construction. For example, the use of a construction presenting an upward air outlet is inefficient for side discharge because of the additional turns the cool air must make in order to reach the desired location. This increased resistance to movement of the cool air decreases the efficiency of the apparatus which, in turn, increases the amount of energy utilized to cool the desired space. Likewise, if an apparatus presenting a side air outlet is employed in an arrangement better suited to a top discharge device, the same problems are encountered.

Therefore, an air conditioning unit is needed that will overcome some of the issues associated with conventional air conditioning units.

BRIEF SUMMARY OF THE INVENTION

It is an object of the present invention to solve the technical problems left unaddressed by the prior art, and to provide an air conditioning unit that utilizes a flexible cold air discharge system which can be directed in an upward or lateral direction depending upon the application desired and orientation of the space to be cooled, thereby providing efficient cool air delivery.

In accordance with this and other objects evident from the following description of the preferred embodiment of the invention, an air conditioning apparatus is provided which includes, among other features, a housing including top and side walls, and presenting an air inlet and first and second air outlets, the first and second air outlets being disposed on different ones of the top and side walls. A blower assembly is provided which includes a central axis about which the blower assembly is supported for rotation relative to the housing, the blower being in fluid communication with the air inlet and the first and second air outlets for forcing air under pressure from the air inlet to the first and second air outlets. The apparatus also includes a first removable air outlet cover assembly for blocking the air under pressure from being discharged through the first air outlet. The first removable air outlet cover assembly includes a first flow control structure for directing air under pressure toward the second air outlet. A second removable air outlet cover assembly blocks the air under pressure from being discharged through the second air outlet, and includes a second flow control structure for directing air under pressure toward the first air outlet.

When the first removable air outlet cover assembly is removed, the second flow control structure of the second removable air outlet cover assembly directs air under pressure toward the first air outlet. When the second removable air outlet cover assembly is removed, the first flow control structure of the first removable air outlet cover assembly directs air under pressure toward the second air outlet.

By providing a construction in accordance with the present invention, numerous advantages are realized. For example, by providing an air conditioning apparatus with structures that allow at least two options for cold air discharge, upward or laterally, a single unit can be utilized for multiple orientations and applications to allow efficient cool air delivery to the space to be cooled. Further, by providing the air conditioning unit of the present invention, it is possible to increase installation efficiency by always having an air conditioning apparatus with the proper air outlet orientation. This improvement is facilitated by the structure provided by the first and second flow control structures.

BRIEF DESCRIPTION OF THE SEVERAL VIEWS OF THE DRAWING

The preferred embodiment of the present invention is described in detail below with reference to the attached drawings, wherein.

DETAILED DESCRIPTION OF THE INVENTION

Figure 1:
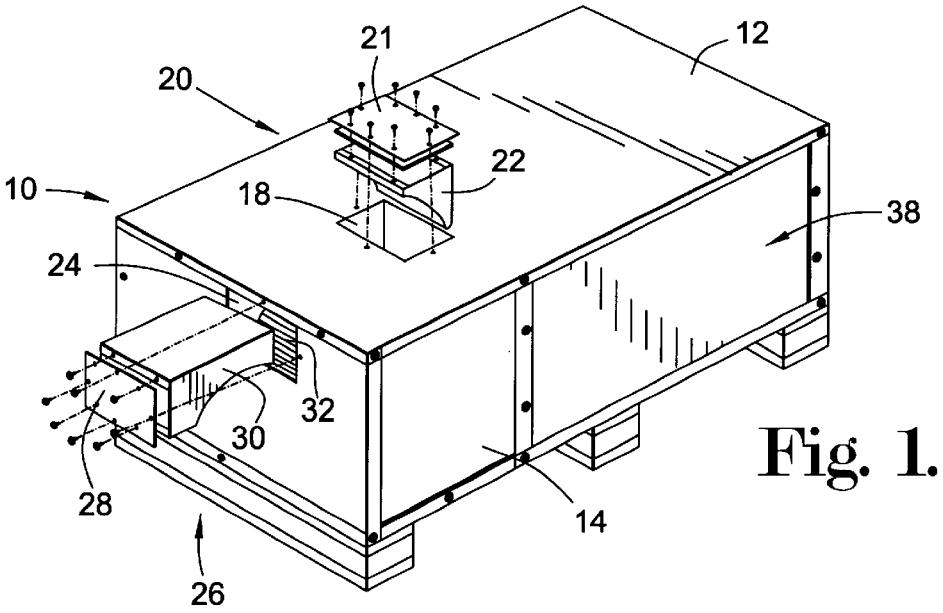
FIG. 1 is a perspective view of an air conditioning apparatus constructed in accordance with the preferred embodiment of the present invention.

An air conditioning apparatus 10 constructed in accordance with the preferred embodiment of the present invention is illustrated in FIG. 1, and broadly includes a frame 12, an air circulation housing 14, a blower assembly 16, a first removable air outlet 18, a first removable air outlet cover assembly 20 including a first flow control structure 22, a second air outlet 24, a second removable air outlet cover assembly 26 including a second removable air outlet cover 28, and a second flow control structure 30.

Figure 2:
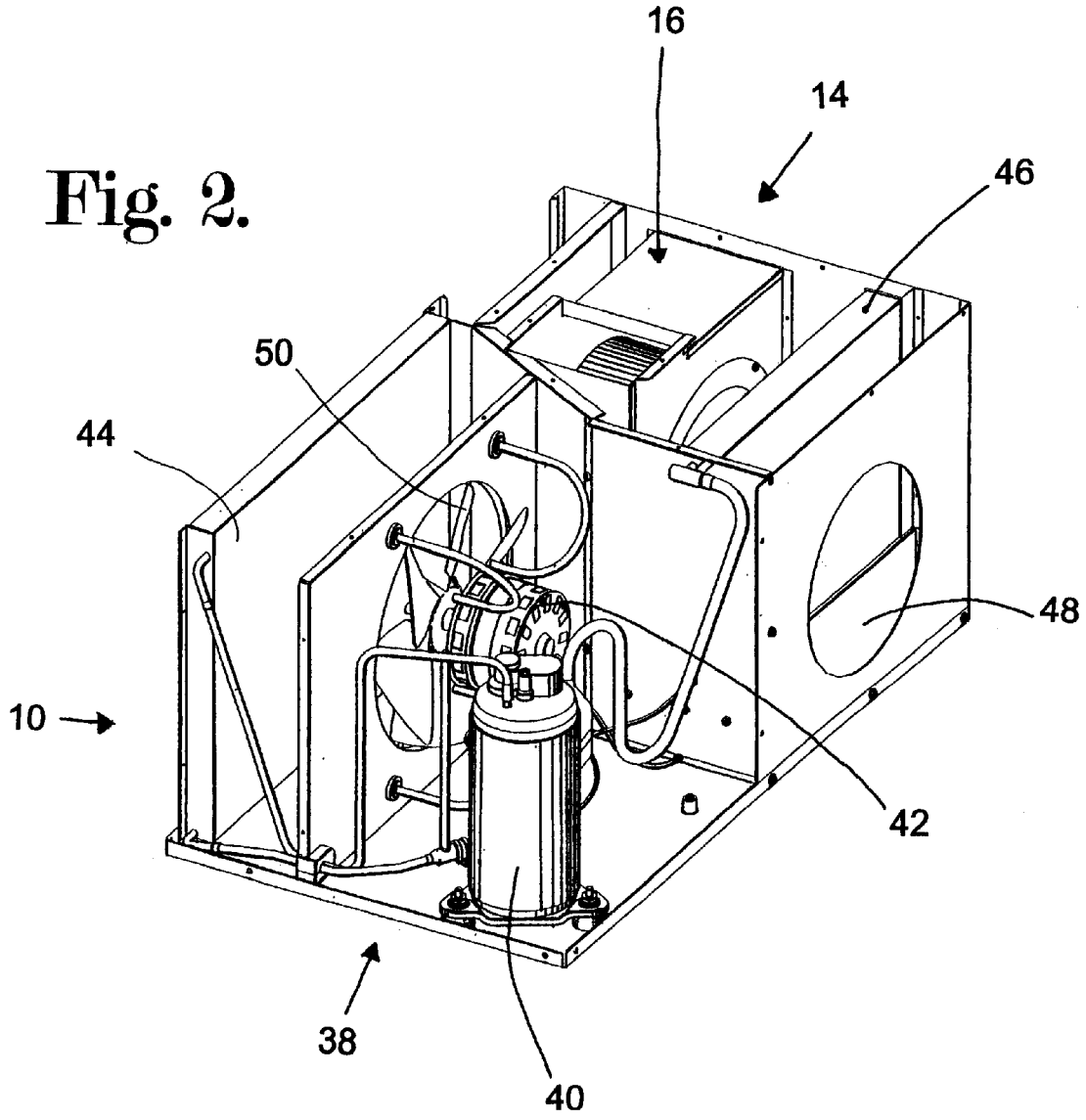
FIG. 2 is a fragmentary perspective view of the apparatus.

As best illustrated in FIG. 2, air conditioning apparatus 10 includes a compressor enclosure 38. The compressor enclosure 38 includes a compressor 40 and a fan motor. The evaporator 46 is used to transfer heat from a coolant prior to entering the compressor 40, after which, the compressed coolant is transferred to the condenser 44. Air is drawn across the evaporator 46 through an air inlet 48 where it is cooled and then forced under pressure to the space to be cooled by the blower assembly 16 which is housed in an air circulation housing 14. After the coolant has passed through the evaporator 46, it is circulated back through to the compressor 40 where it is then recompressed to begin the process again. Those skilled in the art understand the inner workings of an air conditioning apparatus and would appreciate that there are many combinations of the above-described elements comprising a functional air conditioning apparatus.

As best illustrated in FIGS. 1 and 2, a frame 12 is defined by top, bottom and side walls. The frame defines the internal space where the air conditioning components are housed. This internal space is occupied by the air circulation housing 14 and the compressor enclosure 38. The frame 12 can be formed of any temperature-resistant material sturdy enough to support the normal operations of an air conditioning unit. In the preferred embodiment, the frame 12 is formed of sheet metal and held together through conventional fasteners such as screws. A portion of the side walls surrounding compressor enclosure 38 are formed of a metal grill mesh to allow the movement of air through the compressor enclosure 38. The air is moved by functioning of the condenser fan 50 which draws air through the metal grill mesh and into the enclosure 38 and then through the condenser 44.

The air circulation housing 14 houses the evaporator 46 and the blower assembly 16 and includes an air inlet 48. The air circulation housing 14 is defined by a top, bottom, and side walls. The air circulation housing 14 further includes first and second removable air outlets 18, 24. The first and second air outlets 18, 24 are adapted to receive a first and second removable air outlet cover assemblies 20 and 26. These removable air outlet cover assemblies cover the first and second air outlets 18, 24 to prevent the passage of air therethrough. These assemblies 20, 26 also include a first and second removable air outlet cover 21, 28 and a first and second flow control structures 22, 30.

The blower assembly 16 includes a blower 32 which is usually an impeller or the like for drawing air across the evaporator 46 and into the blower assembly 16 where it is forced under pressure to the area to be cooled. In the preferred embodiment, the blower is driven by the blower motor 34. It has been found that the use of two motors, one for the blower 32 and one for the condenser fan 42, has several advantages. For example, by providing a separate motor for the blower assembly, the air conditioning unit will run quieter and more efficient. This configuration, in addition to being quieter and more efficient, allows for the two fans to run independent of each other or simultaneous with each other. Additionally, when two motors are used they don't have to work as hard as single motor. This configuration allows for longer motor life with fewer repairs.

The blower assembly 16 is formed of sheet metal with a blower 32 and the blower motor 34 contained therein. The blower 32 functions to draw air under pressure through the air inlet 48 and across the evaporator 46. The air then enters blower assembly 16 through an opening formed on a side thereof, usually on a side closest to the evaporator 46. The air under pressure is then forced out one of the first or second air outlets 18, 24 depending on the orientation of the apparatus 10 to the area to be cooled. The blower assembly 16, of the present invention, can include several air outlets to select from for forcing the air under pressure to the area to be cooled.

Figure 4:
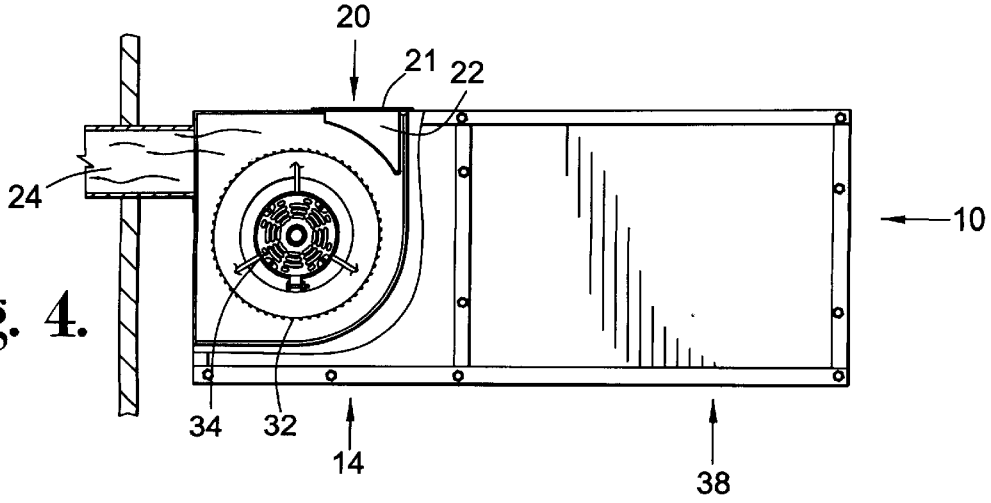
FIG. 4 is a side view of the air conditioning apparatus wherein the air outlet is positioned in a lateral direction.

In the preferred embodiment, the blower assembly 16 includes the first and second air outlets 18 and 24. The first air outlet 18 corresponds with an opening in frame 12 and is adapted to receive the first removable air outlet cover assembly 20. The first removable air outlet cover assembly 20 includes the first removable air outlet cover 21 and the first flow control structure 22. In the preferred embodiment, the first removable outlet cover 21 is formed of sheet metal and blocks the passage of air from passing through the outlet 18. The first removable air outlet cover 21 is coupled to the frame 12 through conventional fasteners such as rivets, screws, or the like. The first flow control structure 22 is coupled to the inner surface of the first removable air outlet cover 21. The first flow control structure 22 is designed to facilitate the flow of air toward the second air outlet 24. While the first flow control structure 22 can be of any shape, such as a flat panel, the preferred embodiment is triangular-shaped having an inner arcuate surface facing the blower 32. The preferred shape of the control structure 22 is best seen in FIG. 4. This shape facilitates the flow of air toward the second air outlet 24 by integrally matching the internal circumferentially extending wall of the blower assembly 16 which is radially spaced from the central axis of the blower 32. The first flow control structure 22 can be formed of any rigid material, such as metal, plastic, Styrofoam, wood, and the like, or a composite thereof.

Figure 3:
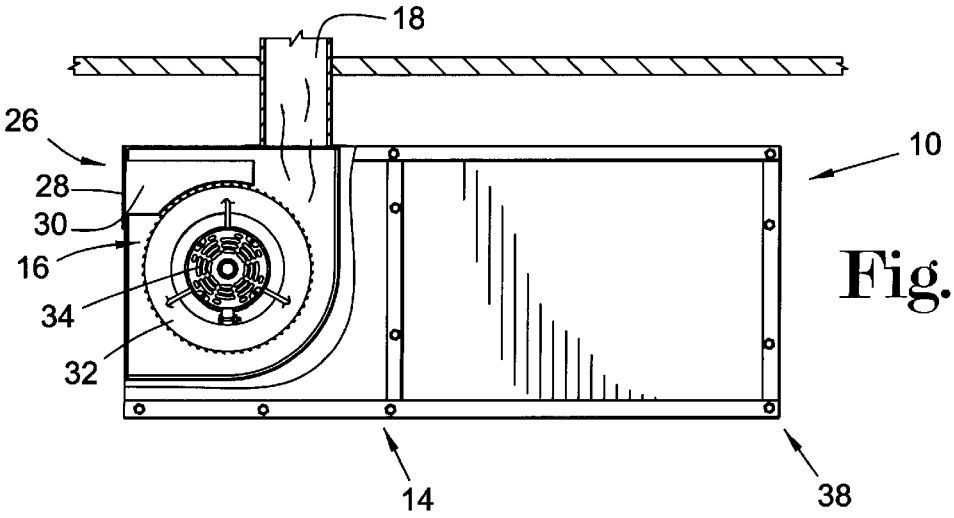
FIG. 3 is a side view of the air conditioning apparatus wherein the air outlet is positioned in an upward direction.

The second air outlet 24 corresponds to an opening formed in frame 12. The second air outlet 24 is adapted to receive the second removable air outlet cover assembly 26. The second removable air outlet cover assembly 26 includes a second removable air outlet cover that blocks the passage of air through the second air outlet 24. In the preferred embodiment, the second removable outlet cover 28 is formed of sheet metal. The second removable air outlet cover assembly 26 further includes the second flow control structure 30 which is coupled to the inner surface of second removable air outlet cover assembly 26. The second flow control structure 30 facilitates directing of air under pressure toward the first air outlet 18 by integrally matching the internal wall of the blower assembly 16. While the second flow control structure 30 can be of any shape, such as a plate, the preferred embodiment of the second flow control structure 30 presents an arcuate lower surface that is radially spaced from the central axis of the blower 32. In addition, the structure 30 presents a generally planar inner end wall that directs air from the outlet 18 when the cover assembly 26 is in place in the outlet 24. This shape facilitates the movement of air under pressure toward the first air outlet 18, as best illustrated in FIG. 3. The second flow control structure 30 can be formed of any rigid material, such as metal, plastic, Styrofoam, wood, and the like, or a composite thereof.

In use, the air conditioning apparatus is placed into position either below or beside the area to be cooled. If the area to be cooled is above the air conditioning apparatus, the first air outlet cover assembly 20 is removed such that the air under pressure is efficiently forced upward. However, if the area to be cooled is lateral with the air conditioning apparatus, the second air outlet cover assembly 26 is removed such that air under pressure is efficiently forced laterally to the air conditioning apparatus. The same air conditioning apparatus can be efficiently utilized for either of the above two examples because of the functioning of the either the second or the first flow control structures 30, 22.

Although the present invention has been described with reference to the preferred embodiment illustrated in the figures of the drawing, it is noted that substitutions may be made and equivalents employed herein without departing from the scope of the invention as recited in the claims.

What is claimed is:

1. An air conditioner apparatus comprising:

a housing including top and side walls, and presenting an air inlet and first and second air outlets, the first and second air outlets being disposed on different ones of the top and side walls;

a blower assembly including a central axis about which the blower assembly is supported for rotation relative to the housing, the blower being in fluid communication with the air inlet and the first and second air outlets for forcing air under pressure from the air inlet to the first and second air outlets;

a first removable air outlet cover assembly for blocking the air under pressure from being discharged through the first air outlet, the first removable air outlet cover assembly including a first flow control structure for directing air under pressure toward the second air outlet; and a second removable air outlet cover assembly for blocking the air under pressure from being discharged through the second air outlet, the second removable air outlet cover assembly including a second flow control structure for directing air under pressure toward the first air outlet;

wherein when the first removable air outlet cover assembly is removed the second flow control structure of the second removable air outlet cover assembly directs air under pressure toward the first air outlet; and wherein when the second removable air outlet cover assembly is removed, the first flow control structure of the first removable air outlet cover assembly directs air under pressure toward the second air outlet.

2. The air conditioning apparatus of claim 1 wherein the blower assembly includes a motor.

3. The air conditioning apparatus of claim 1 wherein the first and second flow control structures are formed of Styrofoam.

4. The air conditioning apparatus of claim 1 wherein the first and second flow control structures are formed of sheet metal.

5. The air conditioning apparatus of claim 1 wherein the first and second flow control structures are formed of plastic.

6. The air conditioning apparatus of claim 1 wherein the first flow control structure is a triangle shape with a concave surface radially spaced from the central axis.

7. The air conditioning apparatus of claim 1 wherein the first flow control structure is a rectangle shape with a concave surface radially spaced from the central axis.

8. The air conditioning apparatus of claim 1 wherein the blower assembly includes a motor for driving the blower.

* * * * *